US005087342A

United States Patent [19]

Stokes

[11] Patent Number: 5,087,342

[45] Date of Patent: Feb. 11, 1992

[54] CONTINUOUS STEEL STRAND ELECTROLYTIC PROCESSING

[75] Inventor: William H. Stokes, Fostoria, Ohio

[73] Assignee: Seneca Wire and Manufacturing Company, Seneca, Ohio

[21] Appl. No.: 409,597

[22] Filed: Sep. 19, 1989

Related U.S. Application Data

[62] Division of Ser. No. 178,593, Apr. 7, 1988.

[51] Int. Cl.[5] ..... C25D 17/00
[52] U.S. Cl. ..... 204/210
[58] Field of Search ..... 204/206, 210, 211

[56] References Cited

U.S. PATENT DOCUMENTS

| | | | |
|---|---|---|---|
| 1,658,222 | 2/1928 | Burns et al. | 204/145 |
| 2,197,653 | 4/1940 | Wilson | 204/1 |
| 2,334,698 | 11/1943 | Faust | 204/140 |
| 2,334,699 | 11/1943 | Faust | 204/140 |
| 2,335,354 | 11/1963 | Ostrofsky | 204/145 |
| 2,338,321 | 1/1944 | Faust | 204/145 |
| 2,347,040 | 4/1944 | Faust | 204/140 |
| 2,366,712 | 1/1945 | Faust | 204/140 |
| 2,424,674 | 7/1947 | White | 204/140 |
| 2,493,579 | 1/1950 | Hammond et al. | 204/140.5 |
| 2,594,124 | 4/1952 | Charlesworth | 204/140.5 |
| 2,607,722 | 8/1952 | Kreml | 204/140.5 |
| 2,820,750 | 1/1956 | Charlesworth | 204/140.5 |
| 2,876,132 | 3/1959 | Worden et al. | 117/50 |
| 3,224,953 | 12/1965 | Russel | 204/212 |
| 3,287,238 | 11/1966 | Latawiec et al. | 204/140.5 |
| 3,338,809 | 8/1967 | Stricker | 204/145 |
| 3,630,864 | 12/1971 | Nakamura | 204/145 |
| 3,676,322 | 7/1972 | Kamata | 204/206 |
| 3,869,371 | 3/1975 | Broughton | 204/206 |
| 3,926,767 | 12/1974 | Brendlinger | 204/145 |
| 4,276,133 | 6/1981 | Nagano | 204/145 |

OTHER PUBLICATIONS

Cotterill, P., "The Hydrogen Embrittlement of Metals", Progess in Materials Science, vol. 9, pp. 230–283.
Weil, R., "Relevant Materials Science for Electroplaters", Electroplating Engineering Handbook, Fourth Edition, pp. 352–365.
Graham, A. K., Electroplating Engineering Handbook, Third Edition, p. 416.
Faust, C. L., "Electropolishing", ACM Handbook, 1964, p. 484 et seq.
Faust, C. L., "Electropolishing", ACM Handbook, 1971, p. 108 et seq.

*Primary Examiner*—T. M. Tufariello
*Attorney, Agent, or Firm*—Fish & Richardson

[57] ABSTRACT

A continuous steel strand is surfaced by (i) passing the strand through an electrolytic unit to remove metal from the surface of the strand, (ii) inducing current in the strand without any direct electrical contact with the strand, and (iii) moving the strand through the unit such that a section of the strand undergoes processing within the electrolytic unit for an extended period of at least twenty-five seconds. Steel valve spring wire is processed by surfacing a strand in an electrolytic process in which no direct electrical contact is made with the strand, and heat treating the strand in a furnace of a kind in which there is no direct mechanical contact between any metal surface and the surface of the strand. The electrolytic unit has a series of electrolytic cells of the kind in which no direct electrical contact is made with the strand, and there is a mechanism for passing the wire through the electrolytic unit more than once. Another feature is a strand of steel wire longer than 100 feet in which the exposed surface is compositionally the same as the interior of the wire and the surface is substantially free of impurities and mechanically imparted scratches.

7 Claims, 4 Drawing Sheets

CONTINUOUS STEEL STRAND ELECTROLYTIC PROCESSING

This is a divisional of co-pending application Ser. No. 178,593 filed on Apr. 7,1988.

BACKGROUND OF THE INVENTION

This invention relates to electrolytic processing of continuous steel strands.

Coiled steel rod or wire used for forming engine valve spring wire, for example, is typically processed by machining the surface to remove scale and other impurities, producing a relatively smooth finished surface. The machining typically leaves small scratches in the surface of the wire that contribute to failure of the valve springs made from it.

It is known to process coiled steel wire by passing it through an electrolytic cell in which a positive voltage is applied directly to the strand by, e.g., conductive metal rollers, while a negative voltage is applied to an electrode immersed in the electrolyte through which the strand is being passed. The metal rollers may scratch the surface of the metal being processed.

Stricker, U.S. Pat. No. 3,338,809, shows an electrolytic technique for cleaning a continuous strand of steel wire without requiring delivering voltage directly to the strand. In Stricker, the strand is made alternately positive and negative by passing it through a series of electrolytic cells in each of which an electrode is positioned near to but not touching the strand. Assuming that the electrode in a given cell is driven positively, the electrodes in the adjacent cells are driven negatively. The electrodes induce alternately positive and negative voltages on the strand.

SUMMARY OF THE INVENTION

A general feature of the invention is in surfacing a continuous steel strand by (i) passing the strand through an electrolytic unit to remove metal from the surface of the strand, (ii) inducing current in the strand without any direct electrical contact with the strand, and (iii) moving the strand through the unit such that a section of the strand undergoes processing within the electrolytic unit for an extended period of at least twenty five seconds.

Another feature of the invention is in processing a steel strand to produce valve spring wire by electrolytically surfacing the strand in an electrolytic process in which no direct electrical contact is made with the strand, and heat treating the strand in a furnace of a kind in which there is no direct mechanical contact between any metal surface and the surface of the strand.

Preferred embodiments of the invention include the following features. The strand is routed to cause it to pass through the electrolytic unit more than once. In the electrolytic unit, the strand is passed through a series of alternately polarized acidic electrolytic cells for removing surface material, and thereafter is passed through a separate electrolytic cell for removing smut. The heat treating step includes passing the wire through a higher temperature furnace, then a quencher, and then a lower temperature furnace. In the furnaces, the wire is heated by a fluidized bed.

Another general feature of the invention is apparatus for surfacing a strand of steel, including an electrolytic unit having a series of electrolytic cells of the kind in which no direct electrical contact is made with the strand, and a mechanism for passing the wire through the electrolytic unit more than once.

Another general feature of the invention is a strand of steel wire longer than 100 feet in which the exposed surface is compositionally the same as the interior of the wire and the surface is substantially free of impurities and mechanically imparted scratches.

The invention produces a strand that is free of surface impurities and surface scratches, is compositionally uniform, and is thus very useful for, e.g., valve spring wire. Wire may be processed in long coils quickly and efficiently. Extended processing time in the electrolytic unit allows removal of substantial amounts of steel. Hydrogen embrittlement is avoided. Passing the strand through the same unit several times allows for a relatively short electrolytic unit. Because the electrolytic processing and tempering are done without metal contacting the strand, surface scratches are minimized.

Other advantages and features will become apparent from the following description of the preferred embodiment and from the claims.

DESCRIPTION OF THE PREFERRED EMBODIMENT

We first briefly describe the drawings.

FIG. 1 is a block diagram of a line for processing coiled steel wire.

FIGS. 2, 3, and 4 are a plan view, a side view, and an end view (partially in section and viewed from the left end of FIG. 2) respectively of an electrolytic unit that is part of the processing line of FIG. 1.

STRUCTURE

Figure 1:
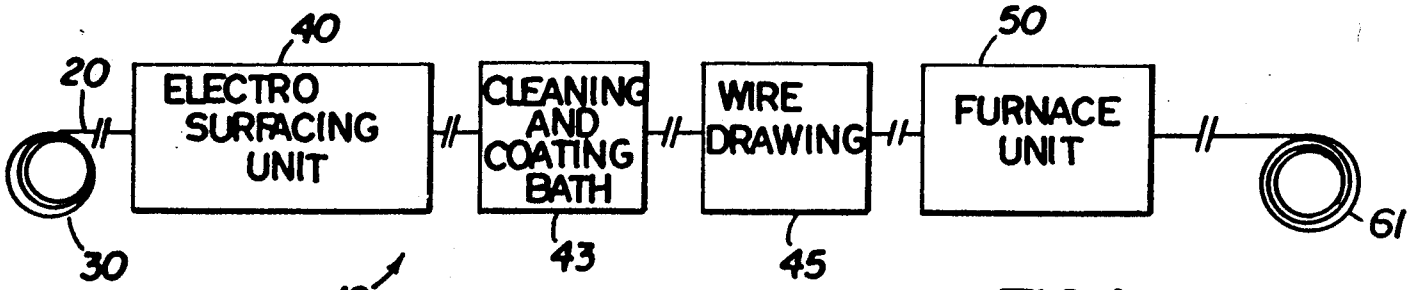

Referring to FIG. 1, in a line 10 for processing a continuous strand 20 of coiled steel rod or wire 30 to produce e.g. valve spring wire, the coiled strand 20 (after being rolled or drawn to the desired diameter) is fed into an electro surfacing unit 40 where a substantial amount of steel is removed from the outer surface to expose a clean and unscarred surface that is compositionally like the metal within the strand. After leaving the electro-surfacing unit, the strand is passed through a cleaning and coating bath 43 that includes a phosphate coating unit, and then through a wire drawing unit 45 (for drawing the wire to a desired diameter). Properly operated, the wire drawing unit will not impart any substantial mechanical imperfections in the surface of the wire. Following the wire drawing unit, the strand is passed through a furnace unit 50 to impart the desired metallurgical properties to the strand. Finally the strand (which may be at least 100 feet long and preferably far longer) is recoiled 61. The strand is recoiled temporarily between the electro surfacing unit and the wire drawing unit and between the wire drawing unit and the furnace unit. The recoilers are not shown in FIG. 1.

Figure 2:
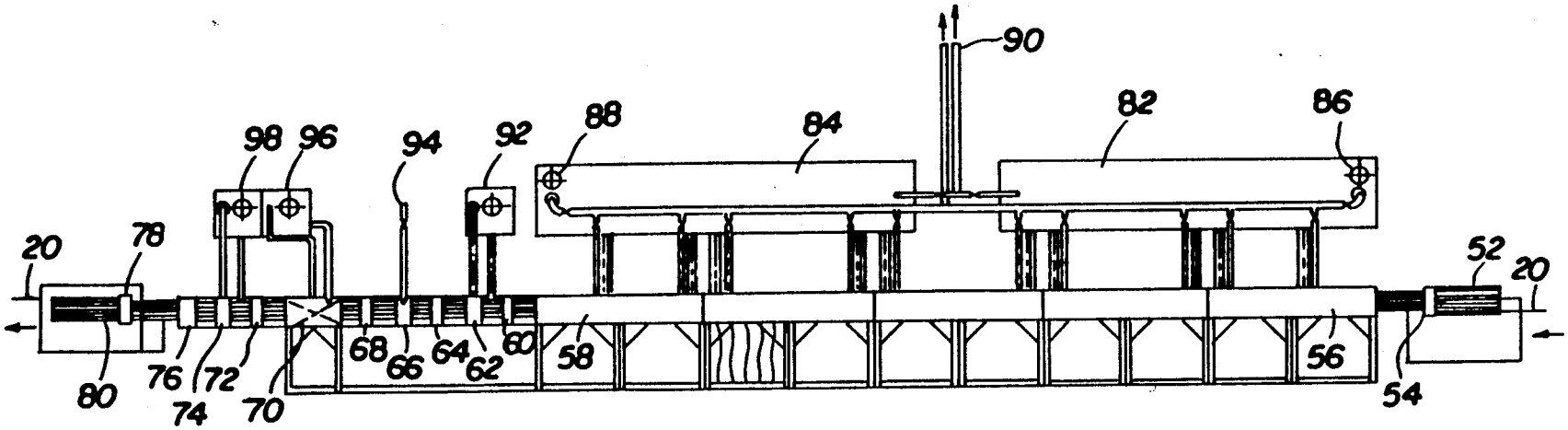
Figure 3:
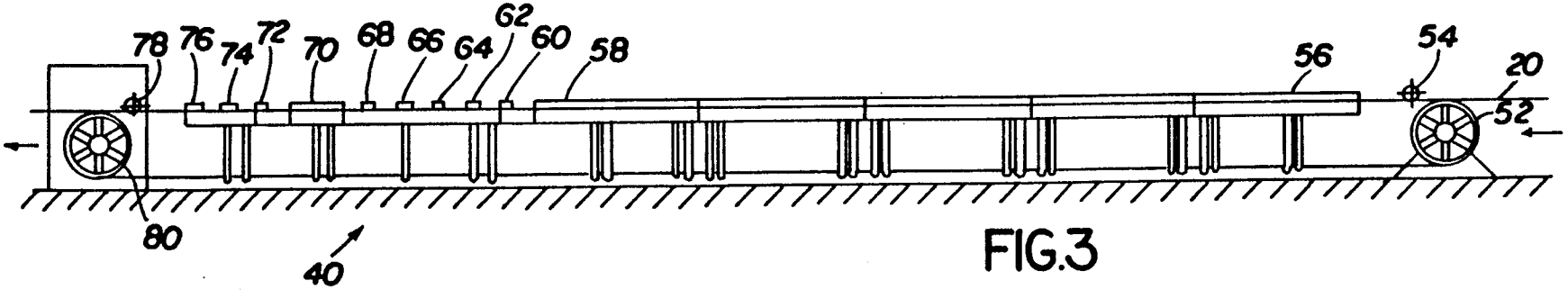

Referring to FIGS. 2, 3, in electro-surfacing unit 40, the wire strand 20 (after passing through a scale breaker, not shown) passes (from right to left in the figures) over the first groove of an idler capstan 52, under a guide sheave 54, and directly into a first bank 56 of electro surfacing cells. Bank 56 is one in a series of five similar banks through which the strand passes in sequence, eventually exiting from the final bank 58. The strand is then routed in turn through an air wipe 60 (at ambient temperature), an acid rinse 62 (water at ambient temperature), an air wipe 64 (at ambient temperature), a fresh water rinse 66 (at ambient temperature), an air wipe 68 (at ambient temperature), a bank of four electrolytic desmutting cells 70 (water solution of sulfuric acid at 110–120 degrees F.), an air wipe 72 (at ambient temperature), an acid rinse 74 (water at ambient temperature), and an air wipe 76 (at ambient temperature). The strand then passes under a guide sheave 78, over the first groove of a drive capstan 80, wrapped around the capstan, reversing its direction, and delivered back to the second groove of the idler capstan. It wraps around that groove, reversing its direction again, and is sent back into the first bank 56. After making up to six passes through the series of banks, the strand exits the electro surfacing unit 40 at the left side of the figures.

The stations along the length of unit 40 are served, via supply and exhaust lines, by a series of tanks and pumps, including electrolyte tanks 82, 84, and pumps 86, 88, an acid recovery pathway 90, an acid rinse tank and pump 92, a fresh water supply 94, an acid tank and pump 96, and an acid rinse tank and pump 98.

Figure 4:
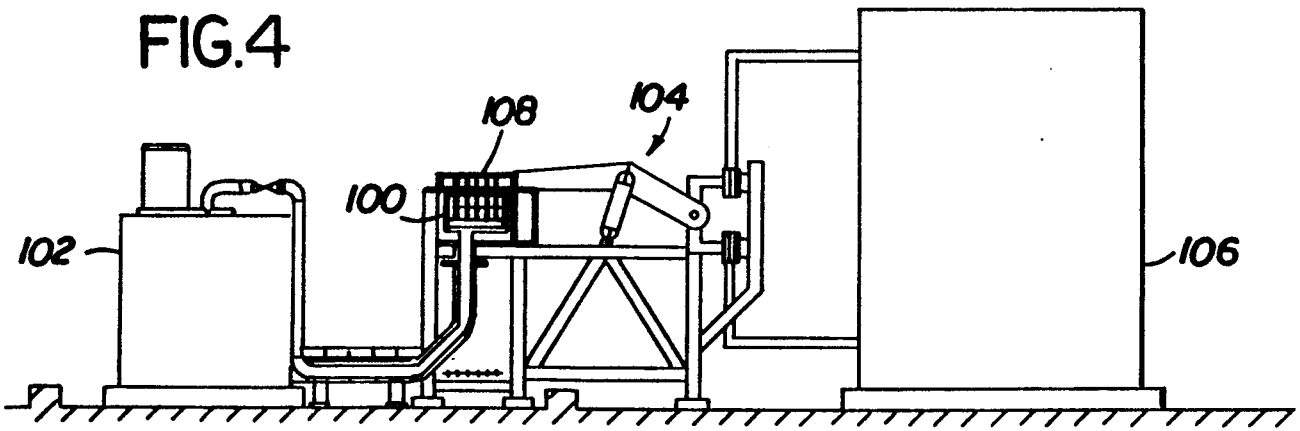

Referring also to FIG. 4, on the opposite side of the electro surfacing cells 100 from the electrolytic tank 102 is a gantry mechanism 104 used for raising, replacing, and lowering electrodes 108 Electricity is fed to the electrodes via the gantry from a set of five rectifiers 106.

Figure 6:
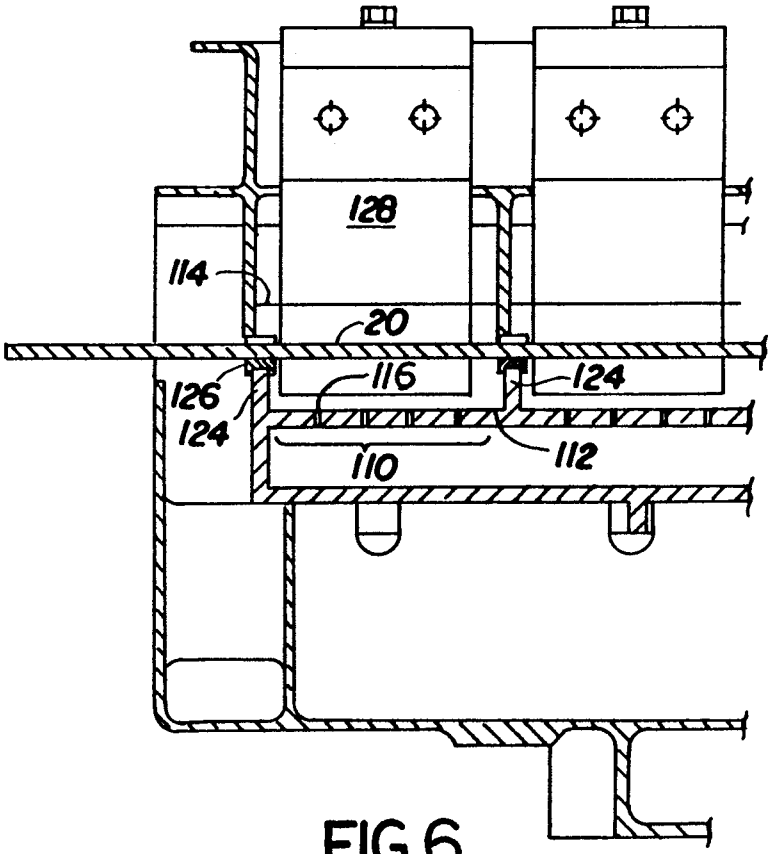
FIGS. 5, 6 are an end view (in section) and a side view (in section) of an electrolytic cell of the electrolytic unit.
Figure 5:
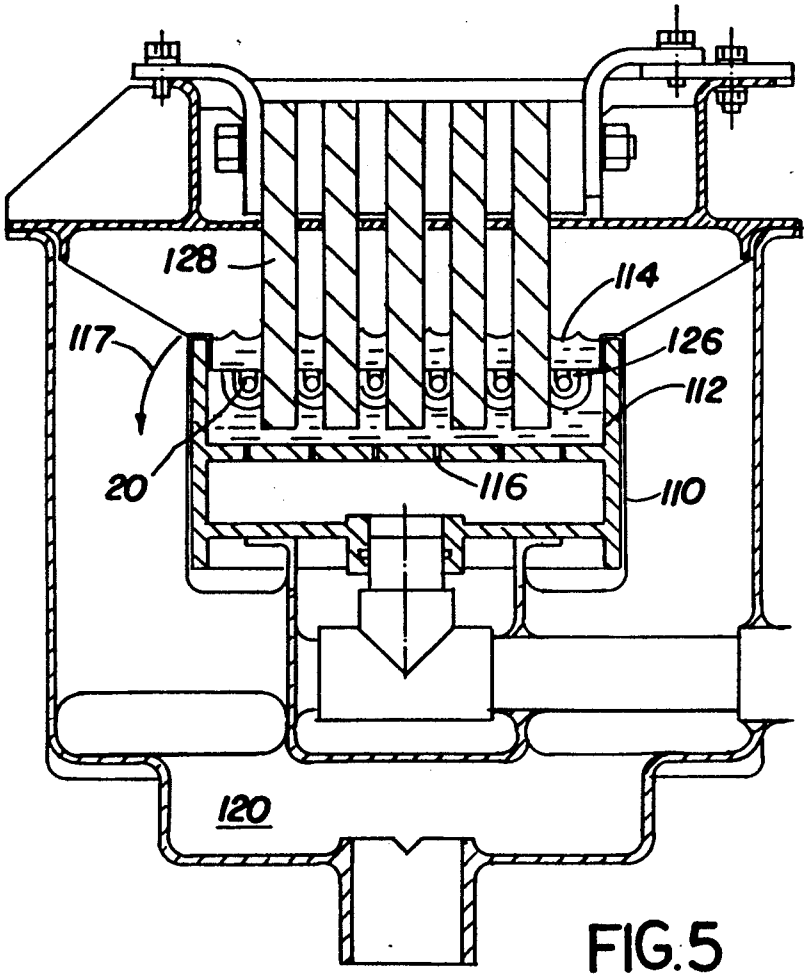

Referring to FIGS. 5, 6, within each bank 56 are a series of twelve cells 110. Each cell 110 includes a tray 112 containing a supply of electrolytic solution 114 through which strand 20 travels in its passes through the electro-surfacing unit. The electrolytic solution is fed from below via small holes 116 in the bottom of the tray, and is discharged by overflowing (arrows 117) the tray and spilling over the sides for collection in a pan 120. Successive cells in each bank of cells are defined by insulating separation walls 122, 124. Ceramic guides 126 are mounted on the separation walls to guide and support the strand 20 as it passes through the bank. Each cell is served by five electrodes 128 that are suspended from the gantry mechanism 104. Each electrode is configured so that its lower end hangs between (but does not touch) two sections of the moving strand 20. All five electrodes serving a given cell are tied together electrically and all are connected to one or the other of the two terminals of rectifiers 106 (the rectifier supplies 60,000 amps at 24 volts DC). The polarities of successive cells alternate. That is, if the electrodes of a given cell are connected to the positive terminal of the rectifiers, the electrodes of the next cell are connected to the negative terminal.

The electrolytic solution is 19–22% sulfuric acid and preferably a maximum of 7% ferrous sulfate, in water. The solution is delivered to the cells at 140 degrees F., but the temperature rises in the cells to an operating temperature of 170 degrees F.

The arrangement of the four electrolytic desmutting cells is similar to that of the main electrolytic cells and the polarities of the four successive cells are alternated in the same way.

Figure 7:
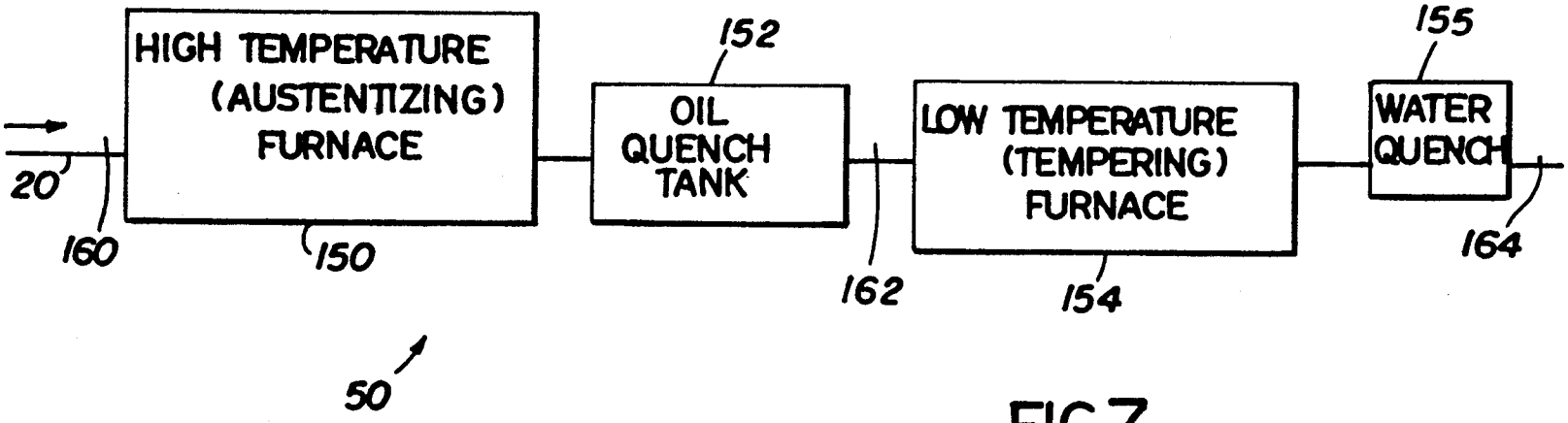
FIG. 7 is a block diagram of the furnace unit of the processing line of FIG. 1.

Referring to FIG. 7, in furnace unit 50, the steel electro-surface steel strand 50 is passed in succession through a high temperature (austentizing) furnace 150 at 1600 degrees F. to impart austentitic qualities to the steel, through an oil quench tank 152 at 130 degrees F., and through a low temperature tempering furnace at from 700 degrees to 1100 degrees F. (depending on the desired tensile strength). The temperature of the strand exiting the oil quench is approximately 155 degrees following furnace 154. The strand is then cooled by a water quench 155.

Both furnaces 150, 152 are fluidized-bed type furnaces in which the steel strand is supported on steel rollers located at opposite ends of each furnace. As the strand passes through the furnace, it is heated by a fluidized bed of sand. This avoids the need for a lead bed or any type of metal hold-down or other metal guiding device that could scratch the surface of the strand. (The furnace unit is available from Rosin Engineering Company, Stourbridge. West Midlands, England). In FIG. 7, the supporting rollers are located at positions 160, 162, 164 and thus the strand touches the rollers only ar locations where the strand is relatively cool.

OPERATION

In electro-surfacing unit 40, as the strand is passed through a given cell whose electrode has a negative voltage, a current is induced in the strand in a direction that causes metal to be removed by dissolution in the electrolyte. When the cell through which the strand is passing has a positive electrode, the current direction in the strand results in its being cleaned. The amount of metal that is removed from the strand depends, among other things, on the total immersion time in negative cells (which depends on the length of the electro-surfacing unit (in this case 40 feet), the speed of the wire through the unit and the number of passes through the unit), the composition and temperature of the electrolyte, and the current per surface area applied to the strand. The objective is to remove a substantial amount (e.g., 0.004 inches) of material (not merely to clean the surface) in order to leave the surface of the strand free of impurities, and free of any scratches or abrasions that may have occurred in the original hot rolling of the steel. This involves immersion times of, e.g., at least 25 seconds, longer than is used for merely cleaning or polishing the surface. One aspect of the invention is the novel long (e.g. more than 100 feet) lengths of impurity-free and scratch free wire that are produced by the process.

For example, to process 0.220 wire the electro-surfacing unit could be operated at a speed of 350 feet per minute, with the strand making all six passes through the unit. For a 40 feet long electro-surfacing unit, the total processing length would then be 240 feet and a total of about 0.004 inches on the diameter would be removed from the surface. The total processing time would be 48 seconds. Electric currents of 40 to 50 amps per square inch of surface are preferred. Similarly 0.3125 wire could be processed at 260 feed per minute using only five passes through the unit to remove 0.004 inches on the diameter in 45 seconds of immersion time. Likewise 0.375 wire would be run at 225 feet per minute in five passes with a total processing time of 45 seconds.

Other embodiments are within the following claims. For example, some of the electrolytic cells may be shut off to reduce the processing time for a given type of wire. The wire may be rerouted through the electrolytic unit fewer than six times. Types of wire other than valve spring wire may be processed.

I claim:

1. Apparatus for processing a steel strand to produce steel valve spring wire comprising an electrolytic unit having a series of electrolytic cells of the kind in which no direct electrical contact is made with the strand, and a fluidized bed furnace for heat treating said strand.

2. The apparatus of claim 1 further comprising a power source to induce current in said strand without any direct electrical contact with said strand.

3. The apparatus of claim 1 further comprising means for causing said strand to undergo processing within said electrolytic unit for an extended period of at least twenty-five seconds.

4. The apparatus of claim 1 further comprising a routing mechanism to cause said strand to pass through said electrolytic unit more than once.

5. The apparatus of claim 1 further comprising an electrolytic cell for removing smut from said strand.

6. The apparatus of claim 1 wherein said furnace comprises a higher temperature furnace, a quencher, and a lower temperature furnace.

7. The apparatus of claim 6 further comprising an acidic cell and a routing mechanism for causing said strand to pass through said electrolytic unit more than once, said strand passing through both said acidic cell and said smut removing cell in each pass.

* * * * *

UNITED STATES PATENT AND TRADEMARK OFFICE

CERTIFICATE OF CORRECTION

PATENT NO. : 5,087,342

DATED : February 11, 1992

INVENTOR(S) : William H. Stokes

It is certified that error appears in the above-indentified patent and that said Letters Patent is hereby corrected as shown below:

On the Title page, item [56], under References Cited, line 12, "2,607,722 8/1952" should be --8,1962 --.

Column 3, line 27, insert --.-- after "108".
Column 4, line 15, "ar" should be --at--.
Column 6, line 9, "claim 6" should be --claim 5--.

Signed and Sealed this

Fifteenth Day of March, 1994

*Attest:*

*Attesting Officer*

BRUCE LEHMAN

*Commissioner of Patents and Trademarks*